US012303048B2

(12) United States Patent
Höller et al.

(10) Patent No.: US 12,303,048 B2
(45) Date of Patent: May 20, 2025

(54) COOLING AND HEATING PLATE

(71) Applicant: JOSEF HÖLLER GMBH, Amstetten (AT)

(72) Inventors: Josef Höller, Neufurth (AT); Joachim Höller, Zeillern (AT)

(73) Assignee: JOSEF HOELLER GMBH, Amstetten (AT)

( * ) Notice: Subject to any disclaimer, the term of this patent is extended or adjusted under 35 U.S.C. 154(b) by 0 days.

(21) Appl. No.: 16/332,299

(22) PCT Filed: Sep. 13, 2017

(86) PCT No.: PCT/AT2017/060227
§ 371 (c)(1),
(2) Date: Mar. 11, 2019

(87) PCT Pub. No.: WO2018/049452
PCT Pub. Date: Mar. 22, 2018

(65) Prior Publication Data

US 2019/0223637 A1 Jul. 25, 2019

(30) Foreign Application Priority Data

Sep. 13, 2016 (AT) ..... A 50817/2016

(51) Int. Cl.
*A47G 19/02* (2006.01)
*A47B 31/02* (2006.01)
(Continued)

(52) U.S. Cl.
CPC ..... *A47G 19/027* (2013.01); *A47B 31/02* (2013.01); *A47F 3/001* (2013.01); *A47F 3/0491* (2013.01);
(Continued)

(58) Field of Classification Search
CPC ..... A47G 19/027; A47B 31/02; A47F 3/001; A47F 10/06; A47F 3/0439; A47F 3/0491;
(Continued)

(56) References Cited

U.S. PATENT DOCUMENTS 4,291,546 A * 9/1981 Rodth ..... F25D 31/002 165/163
4,593,752 A * 6/1986 Tipton ..... A47J 36/2483 165/48.1
(Continued)

FOREIGN PATENT DOCUMENTS

AT 9559 U1 * 12/2007
AT 14176 U1 * 5/2015 ..... A47J 39/006
(Continued)

OTHER PUBLICATIONS

AT14176U1 English machine translation (Year: 2015).*
(Continued)

*Primary Examiner* — Jenna M Maroney
(74) *Attorney, Agent, or Firm* — Andrew Wilford

(57) ABSTRACT

A cooling and heating plate, in particular for serving food and beverages, is connected to a cooling unit and an electrical heating device, preferably a silicone panel heater, is also provided on the under side of the plate. The plate is a multilayered plate having an upper plate, preferably of chrome nickel steel, and an aluminum plate situated thereunder. At least one steel pipe, which is preferably seamless with serpentine curves, having a compressive strength of at least 50 bar is integrally cast in the aluminum plate. As a result, carbon dioxide can also be used as a coolant. Fastening elements can also be integrally cast in the aluminum plate.

7 Claims, 1 Drawing Sheet

(51) Int. Cl.

| | |
|---|---|
| ***A47F 3/00*** | (2006.01) |
| ***A47F 3/04*** | (2006.01) |
| ***F25B 9/00*** | (2006.01) |
| ***F25B 39/02*** | (2006.01) |
| ***F25D 31/00*** | (2006.01) |
| ***F28D 1/047*** | (2006.01) |
| ***F28D 21/00*** | (2006.01) |
| ***F28F 1/22*** | (2006.01) |
| ***F28F 3/12*** | (2006.01) |

(52) U.S. Cl.
CPC ..... *F25B 39/02* (2013.01); *F25D 31/005* (2013.01); *F28D 1/0477* (2013.01); *F28F 1/22* (2013.01); *F28F 3/12* (2013.01); *F25B 9/008* (2013.01); *F25B 2309/061* (2013.01); *F28D 2021/0042* (2013.01); *F28F 2255/146* (2013.01)

(58) Field of Classification Search
CPC ..... A47F 3/0486; A47F 2003/0473; F28D 31/002; F28D 31/005; F28D 1/0477; F28D 2021/0042; A47J 36/2483; A47J 39/006; A47J 39/02
See application file for complete search history.

(56) References Cited

U.S. PATENT DOCUMENTS 5,363,672 A * 11/1994 Moore ..... A47F 3/0491 165/918
5,880,434 A * 3/1999 Pinnow ..... A47J 39/006 219/385
5,899,077 A * 5/1999 Wright ..... F25B 21/02 165/168
5,996,842 A 12/1999 Riley
6,085,535 A * 7/2000 Richmond ..... A47F 3/0439 220/592.02
6,145,333 A * 11/2000 Richmond ..... A47F 3/0439 219/385
6,414,278 B1 * 7/2002 Frohlich ..... A47J 39/02 219/387
6,755,044 B1 * 6/2004 Hildebrandt ..... B01L 7/00 219/523
6,782,195 B2 * 8/2004 Abras ..... F24H 1/162 392/480
6,849,830 B2 * 2/2005 Damiano ..... A47J 36/2483 219/386
7,069,732 B2 * 7/2006 Walker ..... A47F 3/0452 62/258
7,216,500 B2 * 5/2007 Schwichtenberg ..... A22C 17/0013 62/258
7,446,282 B2 * 11/2008 Shei ..... A47J 39/006 219/391
8,151,598 B2 * 4/2012 Wittern, Jr. ..... F25D 17/065 62/408
8,443,616 B2 * 5/2013 Cullen ..... A47F 3/0439 62/258
8,607,587 B2 * 12/2013 Veltrop ..... A47F 3/06 62/443
8,931,293 B2 * 1/2015 Shei ..... A47J 36/2483 219/385
9,003,820 B2 * 4/2015 Veltrop ..... A47J 36/2483 62/229
D737,102 S * 8/2015 Hand ..... D7/542
9,140,484 B2 * 9/2015 Veltrop ..... F25D 25/028
9,140,485 B2 * 9/2015 Veltrop ..... F25D 25/028
9,976,750 B1 * 5/2018 Kestner ..... A47J 36/2488
9,980,322 B1 * 5/2018 Kestner ..... A47J 36/2483
2002/0078706 A1 * 6/2002 Kyees ..... F28D 7/082 62/390
2004/0154312 A1 * 8/2004 Abras ..... F25B 21/02 62/3.7
2004/0261266 A1 * 12/2004 Kirby ..... F28F 7/02 29/890.07
2006/0112719 A1 * 6/2006 Pfeifer ..... F25B 39/02 62/389
2007/0210055 A1 * 9/2007 Konrad ..... A47J 39/006 219/386
2008/0115920 A1 * 5/2008 Uchida ..... F25B 39/02 165/179
2008/0182071 A1 * 7/2008 Cheng ..... A47C 7/748 428/138
2009/0113899 A1 * 5/2009 Dain ..... F25D 11/04 62/48.1
2009/0301701 A1 * 12/2009 Beutler ..... C22C 9/00 165/181
2010/0140251 A1 * 6/2010 Shei ..... A21B 3/00 219/430
2011/0030565 A1 * 2/2011 Shei ..... F25D 31/005 99/329 P
2011/0061417 A1 * 3/2011 Cullen ..... F25D 23/066 62/298
2011/0139399 A1 * 6/2011 Itakura ..... H05B 3/143 165/58
2011/0252813 A1 * 10/2011 Veltrop ..... A47J 39/006 62/3.3
2013/0098102 A1 * 4/2013 Nakayama ..... F25B 30/02 62/510
2014/0260361 A1 * 9/2014 Rodier ..... F25D 21/12 62/80
2015/0136356 A1 * 5/2015 Zhou ..... F25D 31/002 165/61
2015/0201749 A1 * 7/2015 Turner ..... A47B 31/02 62/3.61
2018/0176991 A1 * 6/2018 Gagnon ..... F24H 3/002
2018/0237549 A1 * 8/2018 Takeuchi ..... C08L 33/06

FOREIGN PATENT DOCUMENTS

CN 102151818 A 8/2011
DE 19504286 A1 * 8/1995 ..... F25D 25/028
DE 102007053561 A1 * 8/2008 ..... F28D 1/0477
DE 102007023058 A1 * 10/2008 ..... F28F 13/18
DE 102009020827 A1 * 11/2010 ..... A47F 3/0439
DE 202010014908 U1 * 1/2012 ..... A47B 77/08
DE 202011050444 U1 * 9/2012 ..... A47F 10/06
FR 1562555 A * 4/1969 ..... A47B 31/02
GB 2047587 A * 12/1980 ..... B22D 17/00
JP 2000346515 A 12/2000
JP 2004027988 A 1/2004
JP 2006300354 A * 11/2006 ..... F28F 1/122
WO 2009049240 A2 4/2009
WO 2015161332 A1 10/2015

OTHER PUBLICATIONS

Properties_ Stainless Steel—Grade 304 (UNS S30400)—AZOM (Mar. 2015) (Year: 2015).*
Properties_ Stainless Steel—Grade 316 (UNS S31600)—AZOM (Mar. 2015) (Year: 2015).*
Welded Pipe vs Seamless Pipe—Kelly Pipe (Jan. 2016) (Year: 2016).*
DE102007023058A1 English Translation (Year: 2008).*
JP-2006300354-A English Machine Translation (Year: 2006).*

* cited by examiner

COOLING AND HEATING PLATE

CROSS-REFERENCE TO RELATED APPLICATIONS

The present application is a 371 of International application PCT/AT2017/060227, filed Sep. 13, 2017, which claims priority of A 50817/2016, filed Sep. 13, 2016, the priority of these applications is hereby claimed and these applications are incorporated herein by reference.

TECHNICAL FIELD

The present invention relates to a cooling and heating appliance, in particular for the presentation of food and beverages, in which the appliance is connected to a cooling unit and has an electrical heating device on its lower side. The appliance is designed as a multilayered plate having an upper plate, preferably consisting of chromium-nickel steel, and, situated therebelow, an aluminum plate having coolant ducts.

PRIOR ART

Such a cooling and heating appliance is known from WO 2015/161332. According to this document, the cooling and heating appliance consists of three layers: an upper plate consisting of chromium steel having a thickness of about 1.5 mm, a central plate consisting of aluminum having a thickness of about 5 mm, and a lower plate likewise consisting of chromium steel having a thickness of about 1.5 mm. Coolant ducts are incorporated into the central plate. The connection between the central plate and the upper and the lower plate is achieved according to this document by rolling.

Arranged on the lower side of the lower plate is a heating mat which is covered by a thermal and electrical insulation and tightly closed by a covering shell.

Two things are disadvantageous with this appliance: first, the coolant ducts withstand only relatively low pressures, and second, by virtue of the high pressure upon rolling, the coolant ducts have the effect that the upper plate is not completely planar, with the result that the coolant ducts are noticeable upon corresponding light incidence.

The most future-oriented refrigerant is currently carbon dioxide since it has no influence on the ozone layer and, compared with other refrigerants, has barely any influence on the greenhouse effect. However, carbon dioxide requires high pressures, even on the low-pressure side (that is to say downstream of the evaporator). The known cooling and heating appliance cannot cope with these pressures.

SUMMARY OF THE INVENTION

It is an object of the present invention to overcome these disadvantages and to provide a cooling and heating appliance whose coolant ducts also withstand high pressures and in which the upper plate is planar.

This object is achieved according to the invention by a cooling and heating appliance of the type described above in that at least one steel pipe having a pressure resistance of at least 50 bar is integrally cast in the aluminum plate to form the coolant ducts.

According to the invention, the coolant ducts are thus not produced by milling out the aluminum plate, but by a steel pipe integrally cast during the production of the aluminum plate. As a result, heat transfer between the steel pipe and the aluminum is optimal, and pressure resistance is provided by the steel pipe. Overall, the heat transfer from the refrigerant to the aluminum plate is not substantially poorer than in the known solution described above.

If the steel pipe is bent in a meandering shape, it is also possible to manage with a single steel pipe in large cooling and heating appliances.

Since according to the invention each aluminum plate is produced by casting, the possibility arises of also integrally casting fastening elements in the aluminum plate, with the result that no additional machining operations are necessary for mounting the fastening elements (for example screw bolts).

In order for the steel pipe to withstand high pressures and for pipe breakages to be improbable, it is preferable for the steel pipe to be seamless.

For reasons of the manufacturing outlay and of the weight of the cooling and heating appliance, the aluminum plate should be thin, but, on the other hand, it should be ensured that the steel pipe, even in the case of slight deviations from the planned central position, is sufficiently covered. According to a further preferred feature, there is therefore provision that the aluminum plate has a thickness approximately twice as large as the outside diameter of the steel pipe.

The electrical heating device is preferably a silicone panel heater which is fitted on the lower side of the aluminum plate. Such silicone panel heaters are flat, emit uniform heat and can generate high temperatures. They are therefore well suited for the cooling and heating appliances according to the invention.

BRIEF DESCRIPTION OF THE DRAWINGS

The present invention will be explained in more detail with reference to the appended drawing, in which.

BEST WAY OF IMPLEMENTING THE INVENTION

Figure 1:
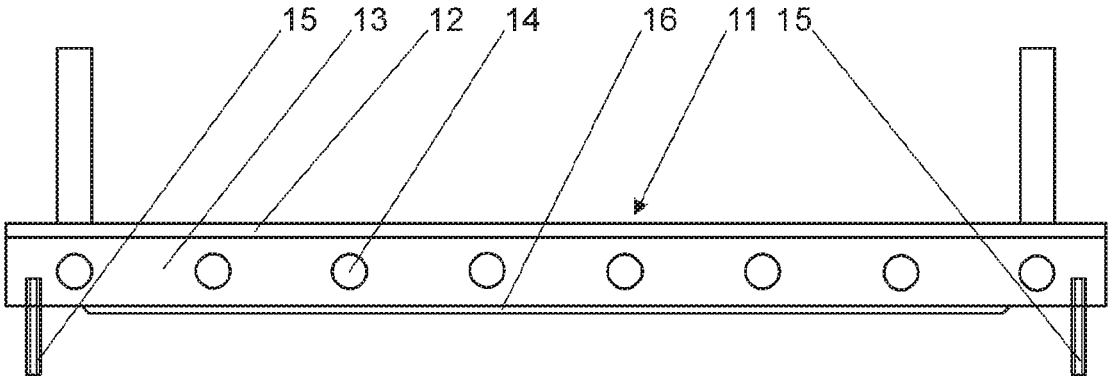
FIG. 1 is a vertical section through a cooling and heating appliance according to the invention.
Figure 2:
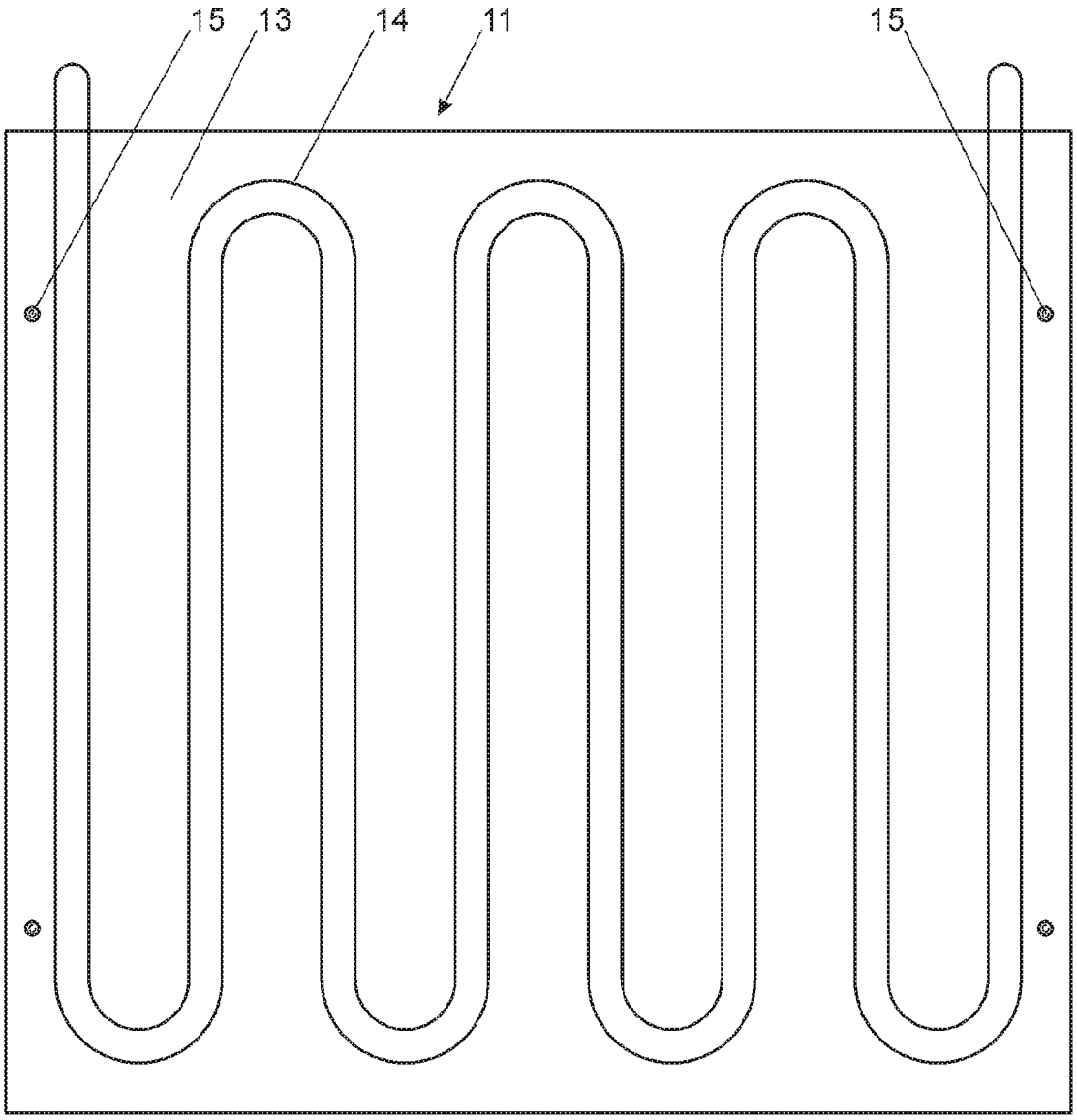
FIG. 2 is a horizontal section through the same cooling and heating appliance.

The cooling and heating appliance is a multilayered plate 11 consisting of an aluminum plate 13 and an upper plate 12. The upper plate 12 bears the beverages to be heated or to be cooled and must therefore, on the one hand, consist of a food-safe material and, on the other hand, must have a sound appearance over years. A preferred material for the upper plate 12 is chromium-nickel steel.

A steel pipe 14 bent in a meandering shape is integrally cast in the aluminum plate 13. This steel pipe 14 has a pressure resistance of at least 50 bar and can therefore also withstand the pressures necessary for refrigerating machines having carbon dioxide as refrigerant. Since the steel pipe 14 is integrally cast in the aluminum, heat-transfer resistance between the steel pipe 14 and the aluminum plate 13 is low. Between the refrigerant (e.g. carbon dioxide) and the aluminum plate 13 there is, of course, additionally the heat resistance of the steel pipe 14, which should therefore be as thin as possible. If use is made of a seamless steel pipe 14, it is possible to manage with wall thicknesses of at most 1 mm without compromising the necessary pressure resistance.

Fastening elements 15 are also integrally cast in the aluminum plate 13. An electrical silicone panel heater 16 is mounted on the lower side of the aluminum plate 13. For heating, this silicone panel heater is switched on, in which case the cooling unit is, of course, switched off. The coolant can remain in the steel pipe 14. Although carbon dioxide then exceeds the critical temperature, the steel pipe 14 withstands the resultant pressures.

For temperature measurement (both during heating and during cooling), a Pt100 temperature sensor can be provided in a conventional manner, and a suitable controller is, for example, the controller ST121-KD1TA. 03FS from Stoerk-Tronic.

This cooling and heating appliance makes it possible, during cooling, to achieve an optimum temperature transfer down to −30° C. The temperature of −30° C. serves for the production of ice cream, directly before the eyes of the consumer. During heating, a temperature of up to 140° C. can be achieved, with the result that food can be kept sufficiently warm. The bottom of the cooling and heating appliance is insulated to suit the requirements The cooling and heating appliance can be operated with carbon dioxide, with the result that the otherwise customary greenhouse gases can be avoided. Of course, however, it can also be operated with all conventional refrigerants, thus also being suitable as a replacement part for existing systems. Isobutane as refrigerant is best suited for a cooling unit mounted directly in the cooling and heating appliance and that has to be correspondingly compact.

The upper plate 12 and the aluminum plate 13 are preferably adhesively bonded to one another with an adhesive having good heat conductivity. If they are connected to one another by rolling, there is the risk that the steel pipe 14 is deformed in the process, resulting in cross-sectional restrictions.

The invention claimed is:

1. A cooling and heating appliance for presentation of food and beverages, the appliance comprising:

a cast aluminum plate;

an upper plate of chromium-nickel steel atop the aluminum plate;

a silicon panel heater fitted on a lower face of the aluminum plate for heating same; and a steel pipe having a wall thickness <1 mm and hence a low heat resistance, adapted to be connected to a cooling unit for cooling the aluminum and upper plates, having a pressure resistance of at least 50 bar, and embedded in and in direct contact with the aluminum plate.

2. The appliance according to claim 1, wherein the steel pipe is shaped as a meander.

3. The appliance according to claim 1, further comprising: fastening elements integrally cast in the aluminum plate.

4. The appliance according to claim 1, wherein the steel pipe is seamless.

5. The appliance according to claim 1 wherein the aluminum plate has a thickness twice as large as an outside diameter of the steel pipe.

6. The appliance according to claim 1, further comprising: carbon dioxide circulating through the steel pipe from the cooling unit.

7. The appliance according to claim 1, further comprising: isobutane circulating through the steel pipe.

* * * * *